US007267034B2

(12) United States Patent
Hsieh

(10) Patent No.: US 7,267,034 B2
(45) Date of Patent: Sep. 11, 2007

(54) TELESCOPIC DRIVING TOOL

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 111 days.

(21) Appl. No.: 11/230,622

(22) Filed: Sep. 21, 2005

(65) Prior Publication Data

US 2007/0062342 A1 Mar. 22, 2007

(51) Int. Cl.
*B25B 23/16* (2006.01)
*B25B 15/00* (2006.01)

(52) U.S. Cl. ..... 81/177.2; 81/436

(58) Field of Classification Search ..... 81/177.2, 81/436, 438, 177.85; 403/109.1, 109.4, 109.5, 403/109.8

See application file for complete search history.

(56) References Cited

U.S. PATENT DOCUMENTS 3,343,434 A * 9/1967 Schroeder ..... 81/60
4,102,375 A * 7/1978 Rossini ..... 81/30
4,960,015 A * 10/1990 Mathews ..... 81/177.2
5,285,702 A * 2/1994 Hillinger ..... 81/177.2
6,155,144 A * 12/2000 Lin ..... 81/438
7,146,885 B2 * 12/2006 Hwang et al. ..... 81/177.2
7,174,812 B1 * 2/2007 Chiang ..... 81/125
2006/0048613 A1 * 3/2006 Abel et al. ..... 81/177.2
2006/0137495 A1 * 6/2006 Hwang et al. ..... 81/177.2
2006/0191384 A1 * 8/2006 Dougherty ..... 81/177.2

* cited by examiner

*Primary Examiner*—D. S. Meislin

(57) ABSTRACT

A telescopic driving tool comprises a handle having an axial hole at a front end thereof for receiving an engaging portion; an interior of an engaging portion being formed with a receiving space; a periphery of the engaging portion being formed with at least one slit; an inner periphery of the engaging portion being formed with an inner thread; a driving rod; one end of the driving rod having an opener head for driving a screw and another end of the driving rod being installed with a thread portion; at least one stopper being installed below the thread portion; the driving rod can be inserted into the receiving space of the engaging portion and the stoppers being received within the two slits of the engaging portion; and a tightening unit being combinable with a front end of the engaging portion for tightly engaging the engaging portion.

3 Claims, 6 Drawing Sheets

TELESCOPIC DRIVING TOOL

FIELD OF THE INVENTION

The present invention relates to a work tool, and particularly to a telescopic driving tool, wherein the length of the driving rod can be adjusted in various stages. Adjustment of the length of the driving rod can be performed easily and the structure of the present invention is strong.

BACKGROUND OF THE INVENTION

Screw openers are generally used tools to drive screws. However in the prior art structure, the size of a screw opener is fixed and as a result, it can not fit for various working environments. Thereby there is an eager demand for a novel design which can adjust the size of the screw opener.

In one improvement, the screw opener has a handle and a driving rod. A front end of the handle has an axial hole. The driving rod has a head for driving a screw unit and a rear end which can be receiving within the axial hole of the handle. A buckle unit is installed between the handle and the driving rod. The buckle unit has a buckle portion in the handle and a control portion installed out of the handle. The driving rod has three recesses for buckling the buckle portion of the buckling unit. The driving rod can be buckled to the buckle unit at different recess by pressing the control portion so as to control the length of the driving rod. There are three stages for adjusting the length of the driving rod.

However above mentioned prior art has the following disadvantages There only three stages for adjusting the length of the driving rod. Furthermore, the structure of this prior art is very complicated. It is very difficult in assembly and moreover, the cost is high. Further the buckle unit can not provide a sufficient endurance to the structure. As a result, in operation, the driving rod will possibly be reduced into the axial hole of the handle. All these defects are necessary to be improved.

SUMMARY OF THE INVENTION

Accordingly, the primary object of the present invention is to provide a telescopic driving tool, wherein the length of the driving rod can be adjusted in various stages. Adjustment of the length of the driving rod can be performed easily and the structure of the present invention is strong.

To achieve above objects, the present invention provides a telescopic driving tool. The telescopic driving tool comprises a handle having an axial hole at a front end thereof for receiving an engaging portion; an interior of an engaging portion being formed with a receiving space; a periphery of the engaging portion being formed with at least one slit; an inner periphery of the engaging portion being formed with an inner thread; a driving rod; one end of the driving rod having an opener head for driving a screw and another end of the driving rod being installed with a thread portion; at least one stopper being installed below the thread portion; the driving rod can be inserted into the receiving space of the engaging portion and the stoppers being received within the two slits of the engaging portion; and a tightening unit being combinable with a front end of the engaging portion for tightly engaging the engaging portion.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
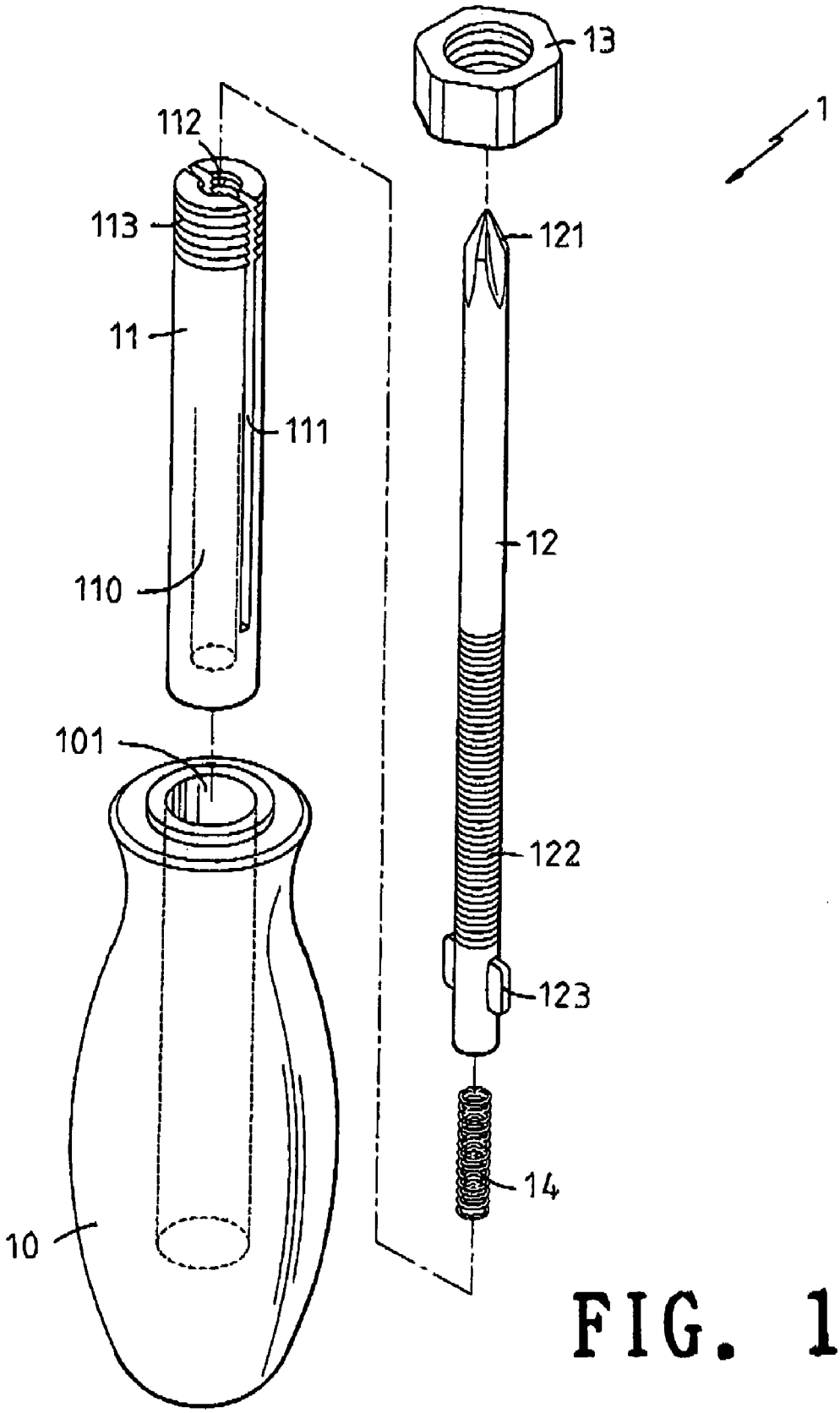
FIG. 1 is an exploded perspective view of the telescopic driving tool of the present invention.

Referring to FIG. 1, the telescopic driving tool of the present invention is illustrated. The present invention has the following elements.

A handle 10 has an axial hole 101 at a front end thereof for receiving an engaging portion 11.

An engaging portion 11 is a hollow structure. An interior of the engaging portion 11 is formed with a receiving space 110. An outer diameter of the engaging portion 11 is slightly smaller than an inner size of the axial hole 101 so that the engaging portion 11 can be received within the axial hole 101 by adhesive material. Two sides of the engaging portion 11 are formed with respective slits 111. The slits 111 are communicated to the receiving space 110. An inner periphery of the engaging portion 11 is formed with an inner thread 112 and an outer periphery of the engaging portion 11 is formed with an outer thread 113.

An elastic element 14 can be placed at a bottom of the receiving space 110 of the engaging portion 11.

A driving rod 12 is included. One end of the driving rod 12 has an opener head 121 for driving a screw and another end of the driving rod 12 is installed with a thread portion 122. Stoppers 123 are installed below the thread portion 122 and on a periphery of the driving rod 12. An outer diameter of the driving rod 12 is slightly smaller than an inner diameter of the receiving space 110 so that the driving rod 12 can be inserted into the receiving space 110 of the engaging portion 11 and then the stoppers 123 are received within the two slits 111 of the engaging portion 11 so that when the driving rod 12 will not rotate idly.

A tightening unit 13 is combinable with a front end of the engaging portion 11 for tightly engaging the engaging portion 11. The tightening unit 13 has a ring shape with inner threads at an inner wall of the ring so as to engage with the outer thread of the engaging portion 11. Thereby the front end of the engaging portion 11 is locked to the tightening unit 13.

Figure 2:
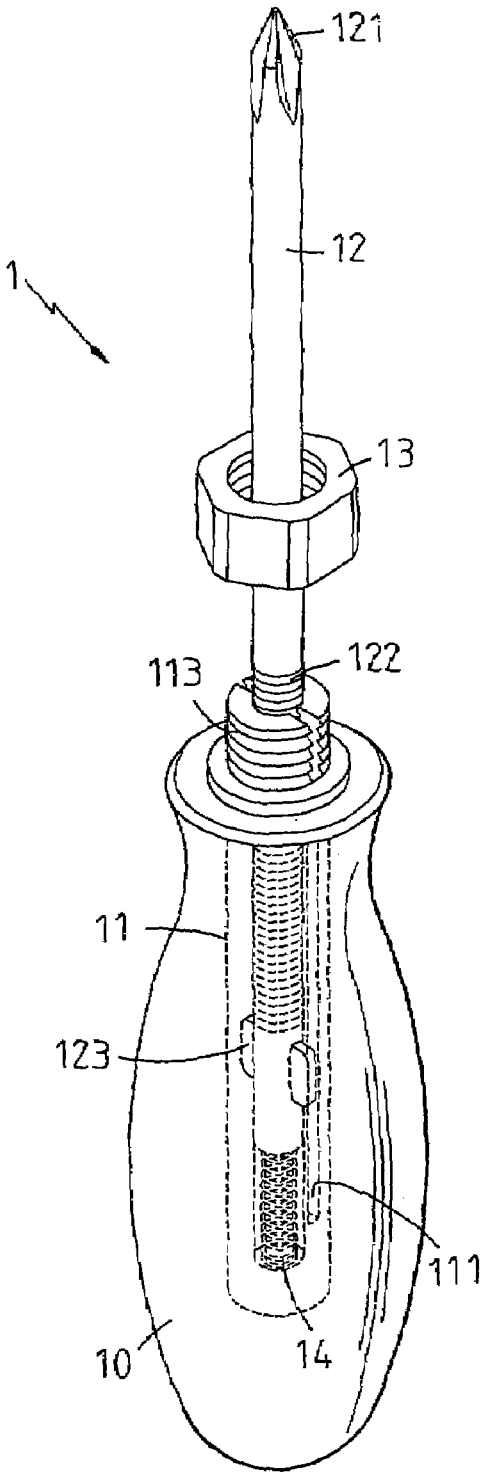
FIGS. 2 and 3 are the assembled schematic views of the telescopic driving tool of the present invention.
Figure 3:
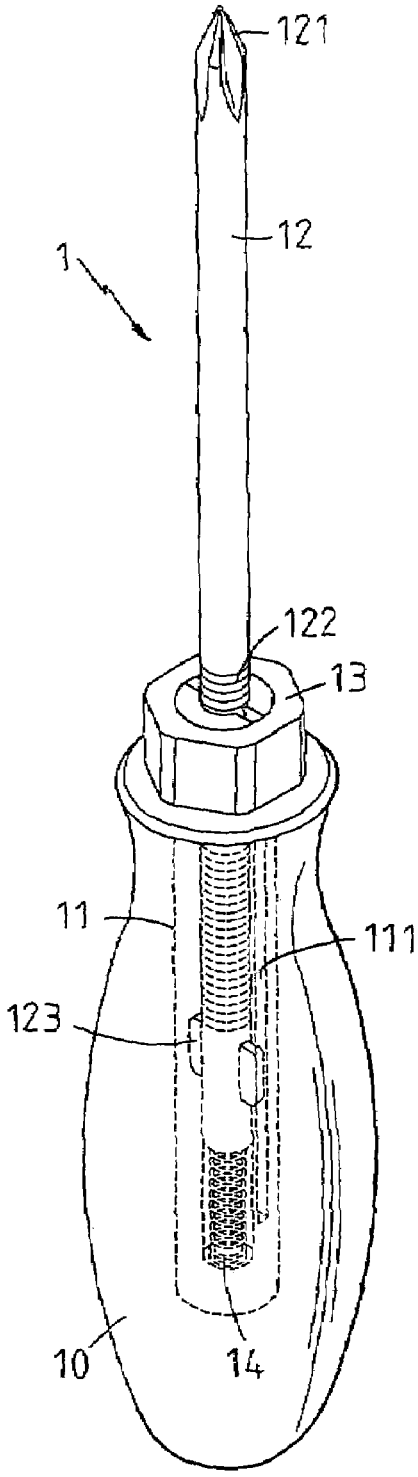

Referring to FIGS. 2 and 3, in assembly of the present invention, the engaging portion 11 is firmly secured to the axial hole 101 of the handle 10. Then the engaging portion 11 is placed on a bottom of the receiving space 110. The end of the driving rod 12 having the stoppers 123 are inserted into the receiving space 110 of the engaging portion 11 50 that the two stoppers 123 are placed into the slits 111 of the engaging portion 11. The end of the driving rod 12 is in contact with the engaging portion 11 and thus resists against the elastic element 14. The tightening unit 13 screws the outer threaded portion 113 of the engaging portion 11. The front end of the engaging portion 11 is locked by the tightening unit 13 so as to reduce inwards. Moreover, the inner thread of the engaging portion 11 is engaged to the thread portion 122 of the driving rod 12 to fix a portion of the driving rod 12 to expose out.

Figure 4:
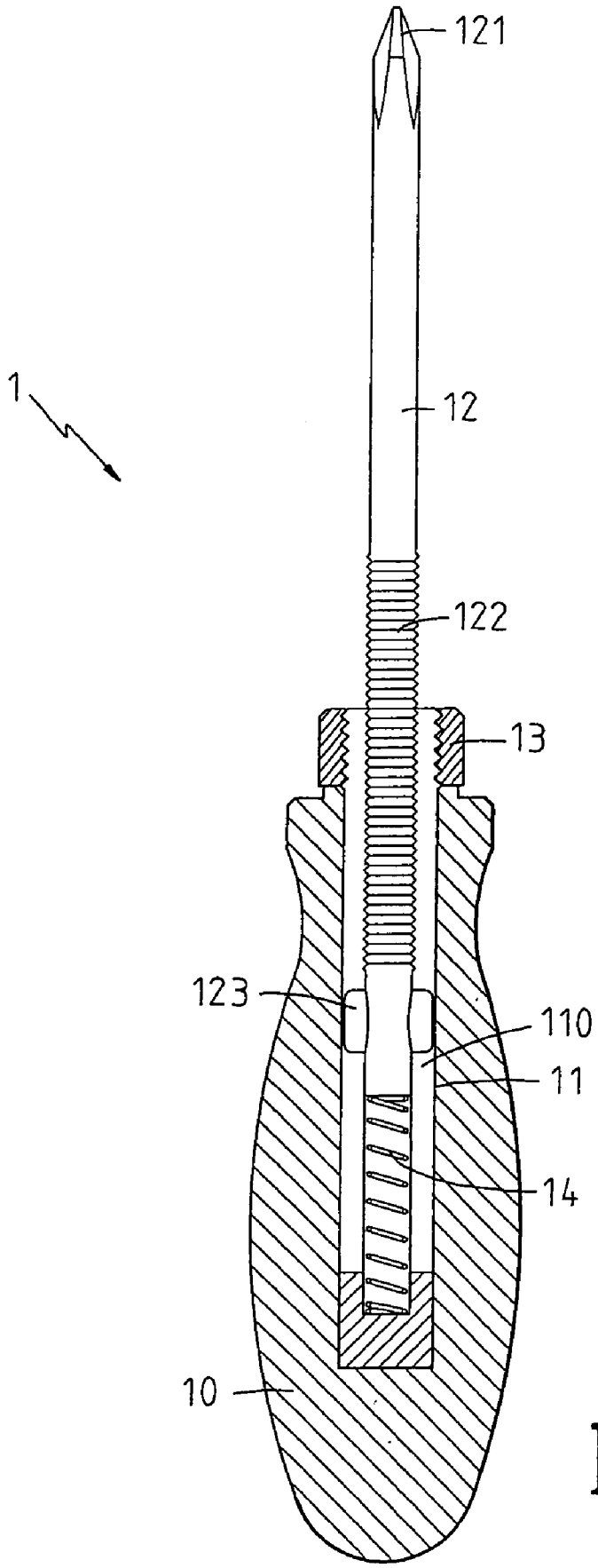
FIG. 4 is a structural cross sectional view about the telescopic driving tool of the present invention.
Figure 5:
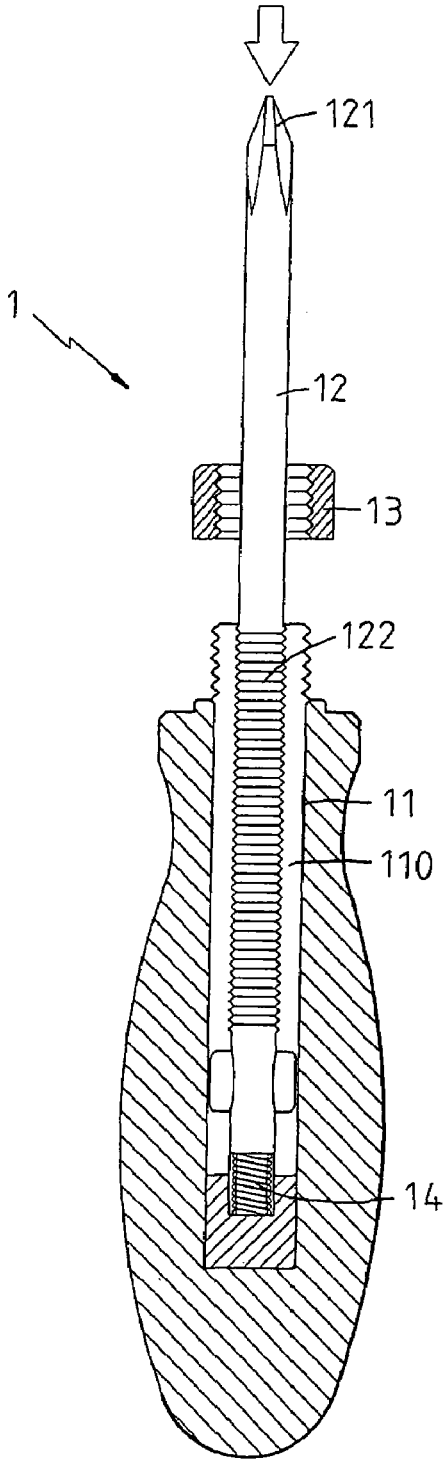
FIGS. 5 and 6 are schematic cross views of the telescopic driving tool of the present invention showing the operation of the adjustment of the length of the driving rod according to the present invention.
Figure 6:
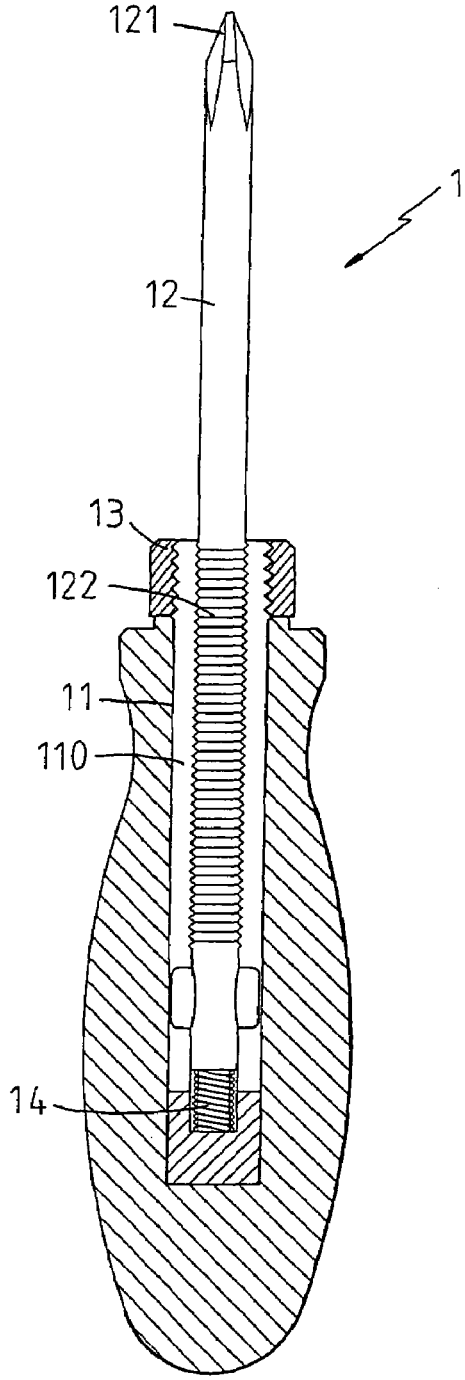

In use of the present invention, referring to FIGS. 4 and 6, if it is desired to adjust and change the length of the driving rod 12, the tightening unit 13 is rotated and then released so that the inner teeth portion 112 of the engaging portion 11 is slightly separated from the thread portion 122 of the driving rod 12. Thereby the driving rod 12 can be telescopically adjusted. The elastic element 14 in the receiving space 110 provides an elastic force to the driving rod 12 so that the driving rod 12 can be drawn out easily. When the driving rod 12 is drawn out to a desired extent, the tightening unit 13 will be locked to the outer threaded portion 113 of the engaging portion 11 again so that the inner teeth portion 112 of the engaging portion 11 is buckled to the thread portion 122 of the driving rod 12. Thus the length of the driving rod 12 is fixed and the opener head 121 at the front end of the driving rod 12 can be used to drive a screw means.

Figure 7:
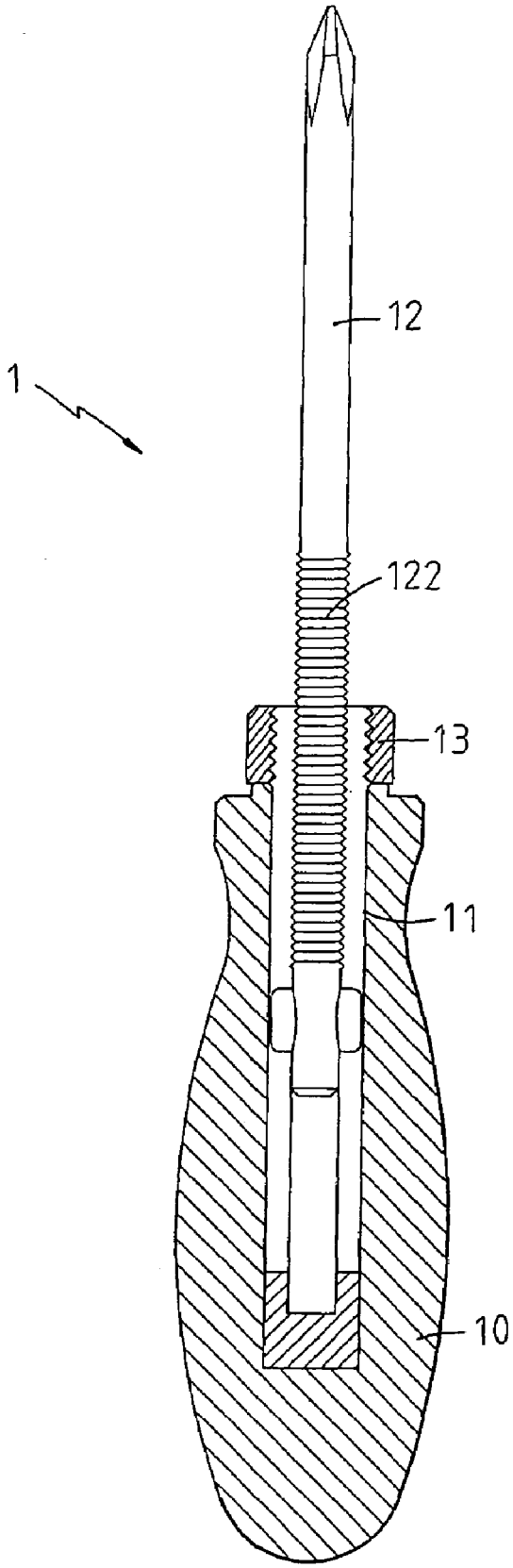
FIGS. 7, 8 and 9 are schematic cross views showing the second embodiment of the present invention.
Figure 8:
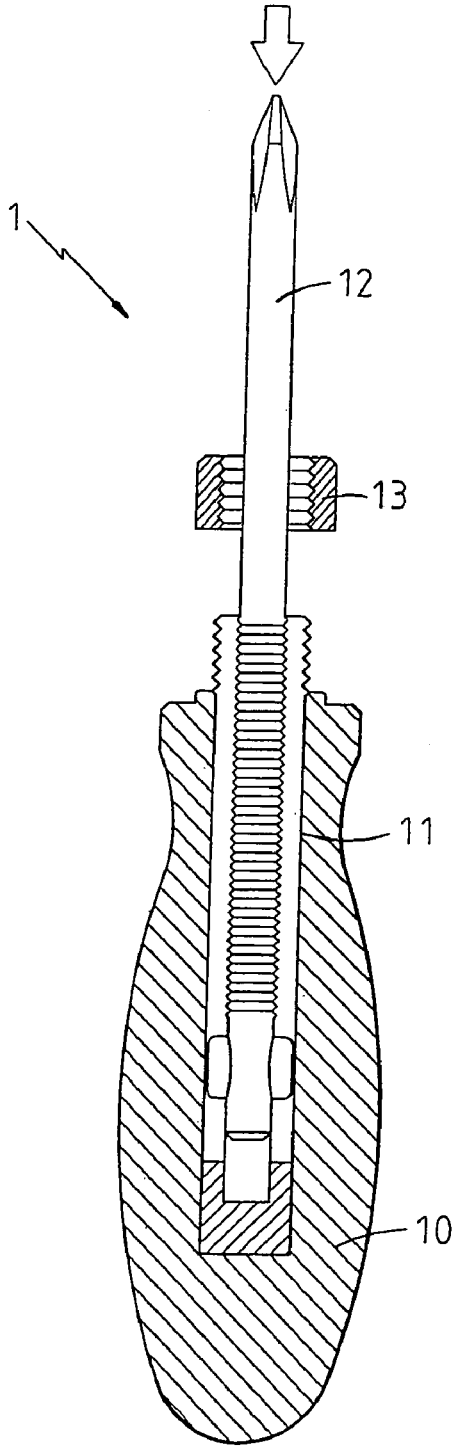
Figure 9:
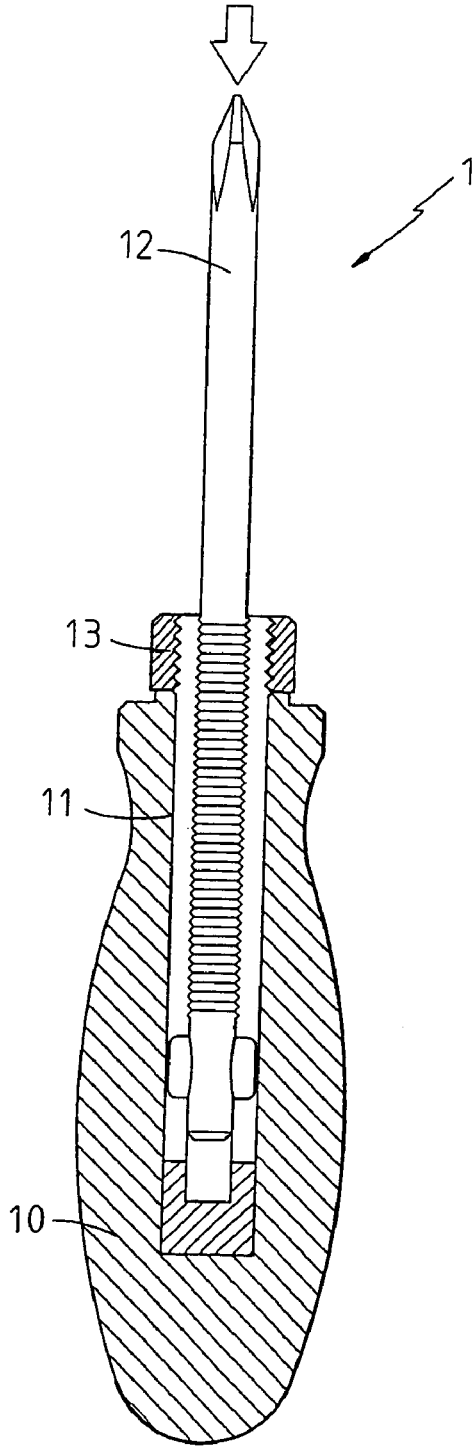

Referring to FIGS. 7 to 9, the second embodiment of the present invention is illustrated. Those identical to the first embodiment will not described herein. Only those different are described. In the present invention, the elastic element 14 can be neglected. Thus no elastic force is provided to the driving rod 12 when the elastic element 14 is drawn out, but the driving rod 12 can still be drawn out by hands.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A telescopic driving tool comprising:

a handle having an axial hole at a front end thereof for receiving an engaging portion;

an engaging portion being a hollow structure; an interior of the engaging portion being formed with a receiving space; an outer diameter of the engaging portion being slightly smaller than an inner size of the axial hole so that the engaging portion is received within the axial hole; a periphery of the engaging portion being formed with at least one slit; an inner periphery of the engaging portion being formed with an inner thread;

a driving rod; one end of the driving rod having an opener head for driving a screw and another end of the driving rod being installed with a thread portion; at least one stopper being installed below the thread portion and on a periphery of the driving rod; an outer diameter of the driving rod being slightly smaller than an inner diameter of the receiving space so that the driving rod can be inserted into the receiving space of the engaging portion so that the inner thread of the engaging portion is engaged to the thread portion of the driving rod; and then the stopper being received within two slits of the engaging portion; and a tightening unit being combinable with a front end of the engaging portion for tightly engaging the engaging portion;

wherein in adjusting a length of the driving rod, the tightening unit can be released so that the inner thread of the engaging portion is disengaged from the thread portion of the driving rod, and thus the driving rod can be telescopically moved.

2. The telescopic driving tool as claimed in claim 1, wherein an elastic element is placed at a bottom of the receiving space of the engaging portion; the elastic element in the receiving space provides an elastic force to the driving rod so that the driving rod can be drawn out easily.

3. The telescopic driving tool as claimed in claim 1, wherein an outer periphery of the engaging portion is formed with an outer thread; the tightening unit has a ring shape with inner threads at an inner wall of the ring so as to engage with the outer thread of the engaging portion.

* * * * *